US009440157B1

(12) United States Patent
Cai

(10) Patent No.: US 9,440,157 B1
(45) Date of Patent: Sep. 13, 2016

(54) YOYO CAPABLE TO BE ELECTRICALLY ACCELERATED WHEN HELD BY HANDS

(71) Applicants: GUANGDONG ALPHA ANIMATION & CULTURE CO., LTD., Guangdong (CN); GUANGDONG AULDEY ANIMATION & TOY CO., LTD., Guangdong (CN); GUANGZHOU ALPHA CULTURE COMMUNICATIONS CO., LTD., Guangdong (CN)

(72) Inventor: Dongqing Cai, Guangdong (CN)

( * ) Notice: Subject to any disclaimer, the term of this patent is extended or adjusted under 35 U.S.C. 154(b) by 226 days.

(21) Appl. No.: 14/390,791

(22) PCT Filed: Nov. 27, 2013

(86) PCT No.: PCT/CN2013/087952

§ 371 (c)(1),
(2) Date: Oct. 6, 2014

(87) PCT Pub. No.: WO2015/014049

PCT Pub. Date: Feb. 5, 2015

(30) Foreign Application Priority Data

Jul. 29, 2013 (CN) ..... 2013 1 0321648

(51) Int. Cl.
*A63H 1/30* (2006.01)
*A63H 29/22* (2006.01)

(52) U.S. Cl.
CPC ..... *A63H 1/30* (2013.01); *A63H 29/22* (2013.01)

(58) Field of Classification Search
USPC ..... 446/236, 242, 246–250, 256
See application file for complete search history.

(56) References Cited

U.S. PATENT DOCUMENTS

| | | | | |
|---|---|---|---|---|
| 5,184,972 | A * | 2/1993 | Tomberlin | A63H 1/30 446/249 |
| 5,984,759 | A * | 11/1999 | O'Sullivan | A63H 1/32 446/250 |
| 7,448,934 | B2 * | 11/2008 | Van Dan Elzen | A63H 1/30 446/236 |
| 7,874,891 | B2 * | 1/2011 | Van Dan Elzen | A63H 1/30 446/236 |
| 8,187,052 | B2 * | 5/2012 | Van Dan Elzen | A63H 1/30 446/247 |
| 8,414,348 | B2 * | 4/2013 | Weems | A63H 1/30 29/426.1 |

(Continued)

*Primary Examiner* — Kurt Fernstrom
(74) *Attorney, Agent, or Firm* — Prakash Nama; Global IP Services, PLLC

(57) ABSTRACT

A yoyo capable to be electrically accelerated when held by hands, characterized in that, it comprises two spinning bodies (1), a connector (2) connecting the two spinning bodies (1) as a whole, side shaft sleeves (3) provided at center positions of outer sides of the spinning bodies (1), an electrical acceleration mechanism provided inside the spinning bodies (1), and a bearing (4) disposed between the two spinning bodies (1) for winding a yoyo string. The electrical acceleration mechanism is connected to the spinning bodies (1). By pressing the side shaft sleeves (3), the electrical acceleration mechanism operates and thus drives the spinning bodies (1) to spin simultaneously. The side shaft sleeves (3) can be pressed to start spinning and accelerating the spinning bodies (1); when the spin speed is high enough, grab the yoyo string and then release the yoyo; the player can then have sufficient time to perform various yoyo tricks. Accordingly, even a short player can play the yoyo. Further, the yoyo can once again be accelerated when its spin speed is too slow. When the side shaft sleeves (3) are not grabbed, the electrical acceleration mechanism stops operating while the yoyo will still continue to spin due to inertia, thereby providing much fun in playing the yoyo. The yoyo has a wide range of utility satisfying the playing needs of kids and children.

10 Claims, 4 Drawing Sheets

(56) References Cited

U.S. PATENT DOCUMENTS

2004/0198151 A1* 10/2004 Bell ..... A63H 1/30 446/247
2005/0048869 A1* 3/2005 Osawa ..... A63H 1/06 446/250
2007/0032164 A1* 2/2007 Chow ..... A63H 1/30 446/249
2010/0210174 A1* 8/2010 Weems ..... A63H 1/30 446/255
2012/0220186 A1* 8/2012 Choh ..... A63H 1/30 446/250

* cited by examiner

YOYO CAPABLE TO BE ELECTRICALLY ACCELERATED WHEN HELD BY HANDS

BACKGROUND OF THE INVENTION

The present invention relates to a yoyo, and more specifically relates to a yoyo capable to be electrically accelerated when held by hands.

Due to the constraints of the retracting and bearing systems of a conventional yoyo, a conventional yoyo cannot be played by a short player because length of the yoyo string is proportional to the player's height. When a taller player releases the yoyo, the yoyo is provided with a sufficiently large acceleration zone for the yoyo to accelerate to a spin speed enough for the player to complete different yoyo tricks. However, when a short player releases the yoyo, the acceleration zone is too tiny and thus the yoyo cannot spin with a speed enough to perform yoyo tricks. Nowadays, the market provides a kind of electrical yoyo, wherein an electrical switch inside the yoyo is connected due to centripetal force when the yoyo is released via a yoyo string, and a motor will then drive a main shaft via gears to rotate so that the whole yoyo is driven to spin; on condition that there is no external force to stop spinning of the yoyo, the yoyo will continue to spin until the battery runs out. This kind of design consumes too much energy and lacks the excitement of competing with time because the yoyo will keep spinning within a certain period of time and so it is difficult to play the yoyo in form of competitive matches. A conventional yoyo is therefore not well received by kids and children.

BRIEF SUMMARY OF THE INVENTION

In view of the aforesaid disadvantages now present in the prior art, the present invention provides a kind of yoyo capable to be electrically accelerated when held by hands. The yoyo according the present invention can provide much fun in playing and can be accelerated when it is being held by hands.

The present invention is attained as follows:

A yoyo capable to be electrically accelerated when held by hands, characterized in that, it comprises two spinning bodies, a connector connecting the two spinning bodies as a whole, side shaft sleeves provided at center positions of outer sides of the spinning bodies, an electrical acceleration mechanism provided inside the spinning bodies, and a bearing disposed between the two spinning bodies for winding a yoyo string; the electrical acceleration mechanism is connected with the spinning bodies; by pressing the side shaft sleeves, the electrical acceleration mechanism operates and thus drives the spinning bodies to spin simultaneously.

The electrical acceleration mechanism comprises a power supply mechanism and a drive mechanism; to ensure that the two spinning bodies are balanced in weight, the power supply mechanism is provided in a first spinning body of the spinning bodies; the drive mechanism is provided in a second spinning body of the spinning bodies; the power supply mechanism is connected with the side shaft sleeves so that when the side shaft sleeves are pressed, power is supplied to the drive mechanism to drive the spinning bodies to spin simultaneously.

In order to control electricity connection, the power supply mechanism comprises a battery provided inside a cavity of the first spinning body, a first spring sleeving the connector, a gasket, a Printed Circuit Board (PCB) and a touch switch provided on the PCB; the first spring is provided between the gasket and the PCB; by pressing the side shaft sleeves inwardly, the gasket is pressed inwardly to touch the touch switch to enable electrical connection. Further, the drive mechanism comprises a motor fixed in a cavity of the second spinning body of the spinning bodies, a gear box engaging a small gear of the motor, a second spring sleeving the connector and a motion transmission member capable to transmit motion of the motor to the spinning bodies; when the side shaft sleeves are pressed inwardly, the motion transmission member engages with a first gear of the gear box so that rotation of gears is transformed to spinning of the spinning bodies.

To facilitate removal and replacement, the connector comprises two hollow link rods and a hollow shaft; the two hollow link rods are mounted on the center positions of the spinning bodies respectively; one end of each of the two hollow link rods is fixedly connected with a respective spinning body, while another end of each of the two hollow link rods is connected with a respective side shaft sleeve by rotation via a side shaft bearing; the hollow shaft is provided between the two hollow link rods and connects the two hollow link rods by threaded connection so that the spinning bodies are connected to form a one whole yoyo.

To facilitate wiring of electrical wires, the two hollow link rods are provided with through bores at their center positions respectively and each through bore is opened through side walls of a respective hollow link rod; the electrical wires between the power supply mechanism and the drive mechanism are capable to run through the through bores and being arranged in the hollow link rods and the hollow shaft.

To control the motion transmission member, the motion transmission member comprises a first friction wheel and a second friction wheel; the first friction wheel sleeves a wheel shaft of a second gear of the gear box so as to rotate together with the second gear; the second friction wheel is mounted to an inner side surface of a right side shaft sleeve of the side shaft sleeves; by pressing the side shaft sleeves inwardly so that the first friction wheel and the second friction wheel contact with each other, rotational movement of the first friction wheel is transferred to the second friction wheel to rotate the second friction wheel which in turn drives the spinning bodies to spin.

In order that the center of gravity of the second spinning body is maintained at a central axis position thereof, a mounting seat is provided at one side of a bottom part of the cavity of the second spinning body; a counterweight seat is provided at a side symmetrical to where the mounting seat is disposed to balance the center of gravity of the second spinning body; the motor and the gear box are mounted in the mounting seat.

The present invention comprises two side shaft sleeves extending out of the center positions at the outer sides of the spinning bodies and an electrical acceleration mechanism provided in the spinning bodies, whereas the electrical acceleration mechanism is connected with the spinning bodies, and by pressing the side shaft sleeves, the electrical acceleration mechanism operates and thus drives the spinning bodies to spin. When the idle rotation speed of the yoyo is slow, the side shaft sleeves can be pressed to accelerate spinning of the yoyo so that players are provided with sufficient time to perform more yoyo tricks; alternatively, when the yoyo is not spinning, the side shaft sleeves can be pressed to start spinning the spinning bodies, and when the spin speed is high enough, grab the yoyo string and then release the yoyo to perform various yoyo tricks. Accordingly, even a short player can play the yoyo. The yoyo of the present invention has a wider range of utility satisfying the playing needs of kids and children. Also, the yoyo spinning speed can be accelerated when it is too slow, and when the side shaft sleeves are not grabbed, the electrical acceleration mechanism stops operating while the yoyo will still continue to spin due to inertia and will gradually reduce in speed and eventually stop spinning. Therefore, the yoyo can provide the excitement of competing with time and allow players to play in the form of competitive matches. At the same time, the ways of playing the yoyo are increased, thereby providing much fun in playing the yoyo. Further, since the electrical acceleration mechanism is designed to be formed by the power supply mechanism and the drive mechanism whereas the power supply mechanism is disposed in one spinning body and the drive mechanism is disposed in another spinning body, weight balance of the two spinning bodies can be ensured so as to maintain the center of gravity of the yoyo at a central axis position. Accordingly, when the yoyo is driven by the yoyo string to spin, the yoyo can be ensured to spin steadily and also with a longer spinning time. In summary, the yoyo of the present invention has a smart design and provides various ways of playing the yoyo. Players can have much fun in playing the yoyo. The yoyo of the present invention satisfies the playing needs of short players and allows players to create their own ways of playing the yoyo so that the yoyo can remain to be an appealing toy even after a long period of time.

BRIEF DESCRIPTION OF THE DRAWINGS

The present invention is now further described with reference to the accompanying figures.

DETAILED DESCRIPTION OF THE INVENTION

As shown in FIGS. 1-4, a yoyo capable to be electrically accelerated when held by hands comprises two spinning bodies 1, a connector 2 connecting the two spinning bodies 1 as a whole, side shaft sleeves 3 provided at center positions of outer sides of the spinning bodies 1, an electrical acceleration mechanism provided inside the spinning bodies 1, and a bearing 4 disposed between the two spinning bodies 1 for winding a yoyo string. The electrical acceleration mechanism is connected with the spinning bodies 1. By pressing the side shaft sleeves 3, the electrical acceleration mechanism operates and thus drives the spinning bodies 1 to spin simultaneously. Therefore when idle rotation speed of the yoyo is slow, the side shaft sleeves 3 can be pressed to accelerate spinning of the yoyo to increase the spinning time of the yoyo so that players are provided with sufficient time to perform more yoyo tricks; alternatively, when the yoyo is not spinning, the side shaft sleeves 3 can be pressed to start spinning the yoyo, and when the spin speed is high enough, grab the yoyo string and then release the yoyo to perform various yoyo tricks. Accordingly, even a short player can play the yoyo. The yoyo of the present invention has a wider range of utility satisfying the playing needs of kids and children. Also, when the side shaft sleeves 3 are released and the electrical acceleration mechanism stops operating, the yoyo will continue to spin due to inertia and will gradually reduce in speed and eventually stop spinning. Therefore, the yoyo of the present invention can provide the excitement of competing with time and allow players to play in the form of competitive matches. At the same time, the ways of playing the yoyo are increased, thereby providing much fun in playing the yoyo.

Figure 1:
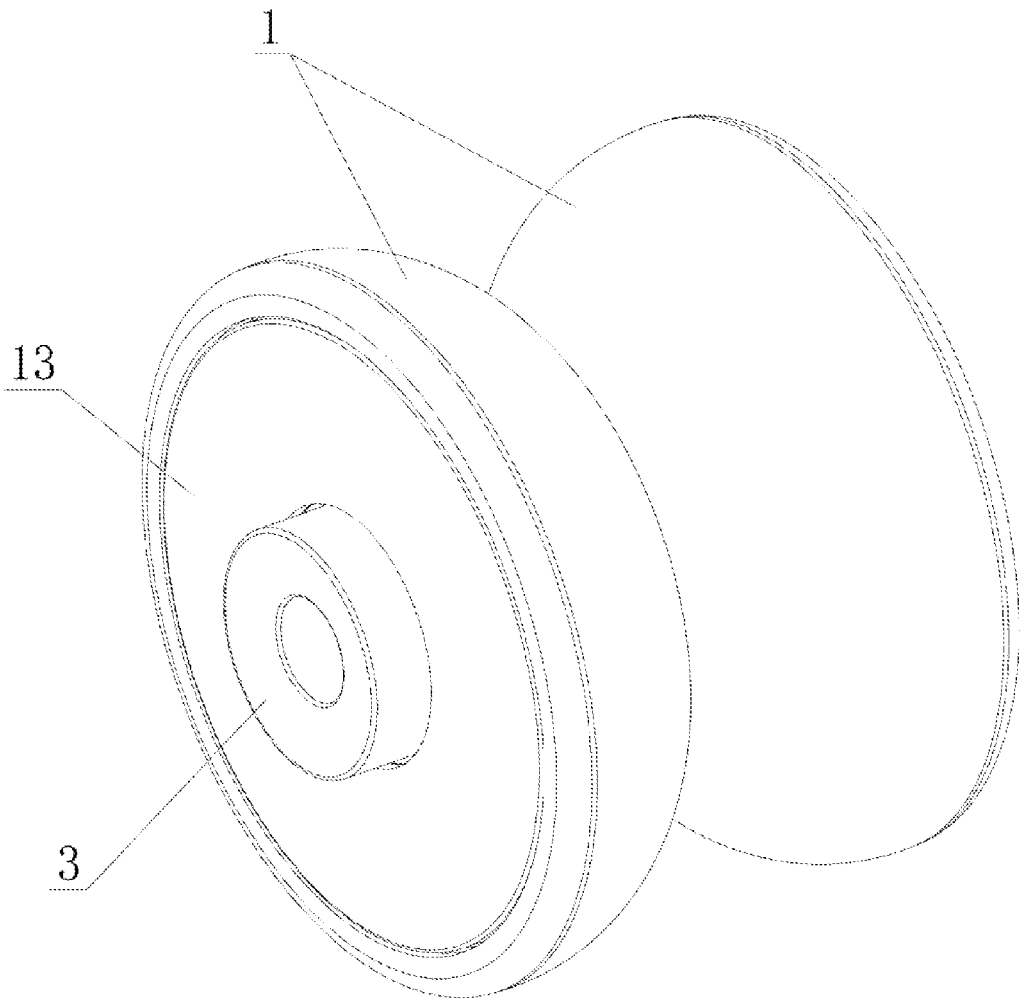
FIG. 1 is a perspective view showing the structure of the present invention.
Figure 2:
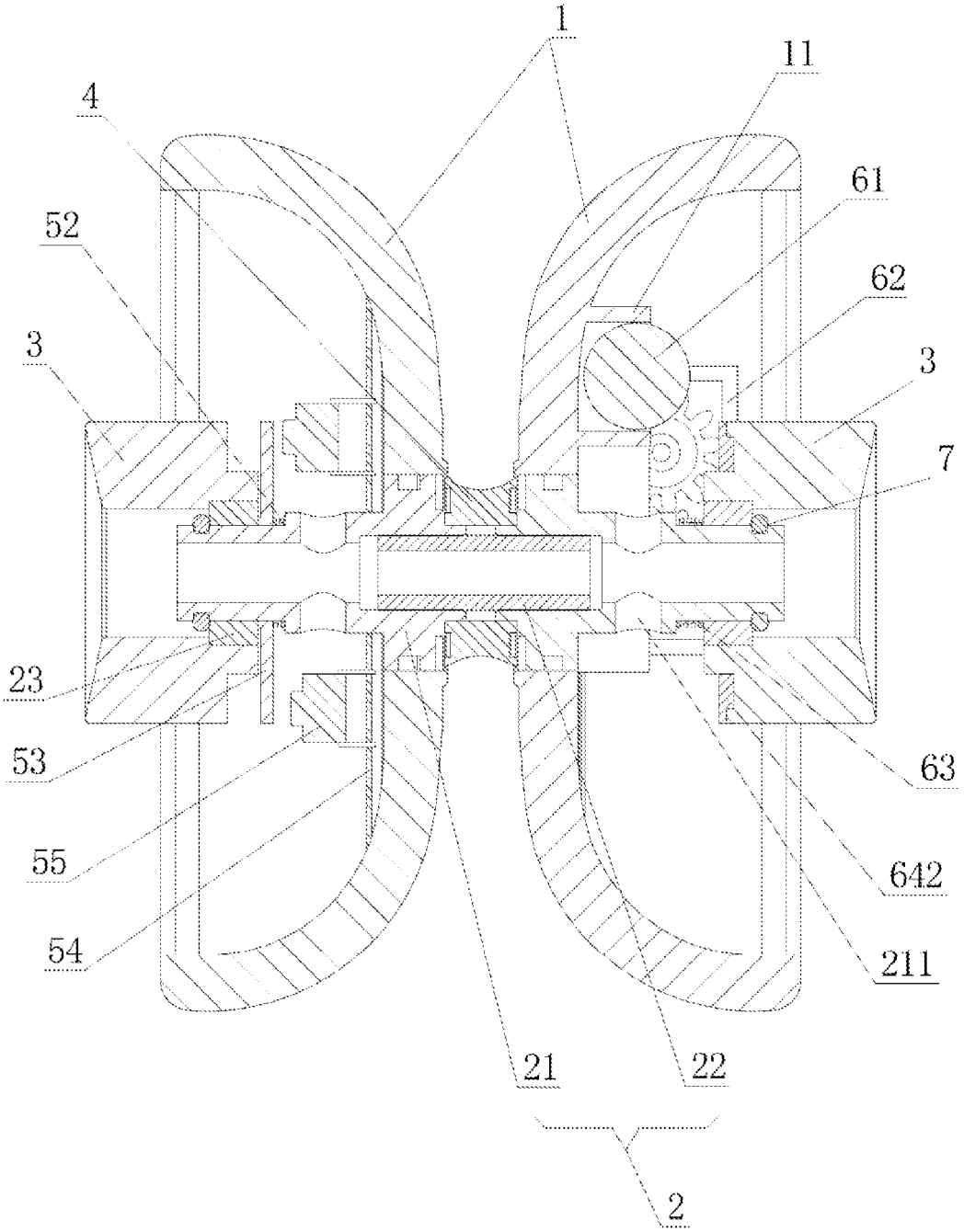
FIG. 2 is a sectional view showing the structure of the present invention.
Figure 3:
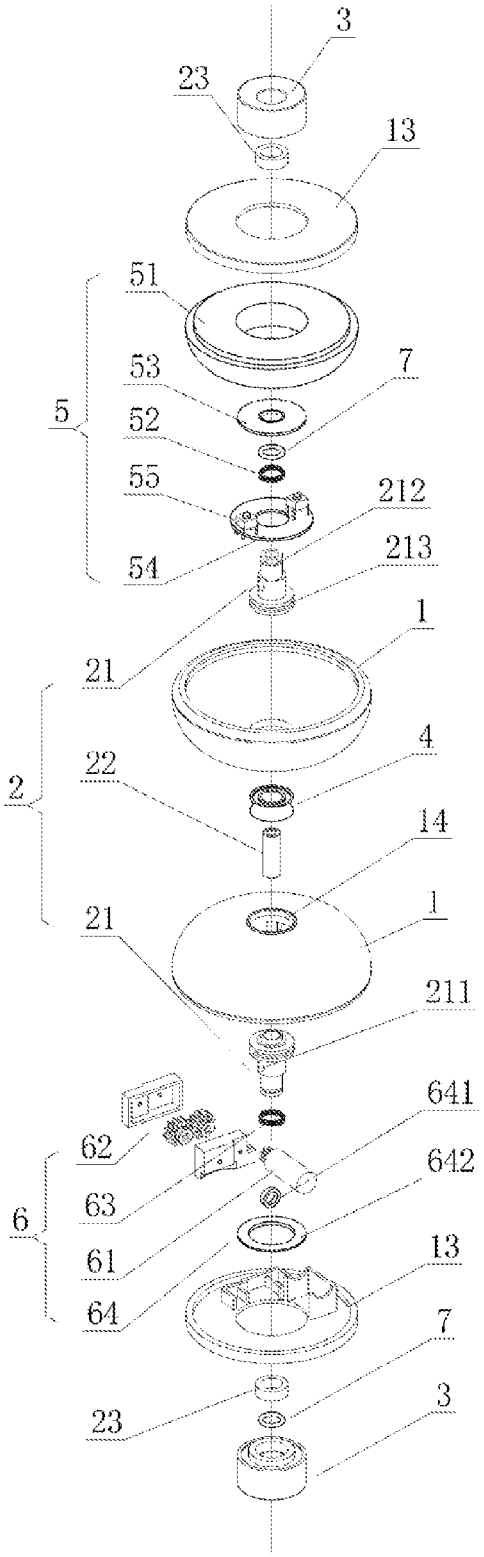
FIG. 3 is an exploded view showing the structure of the present invention.
Figure 4:
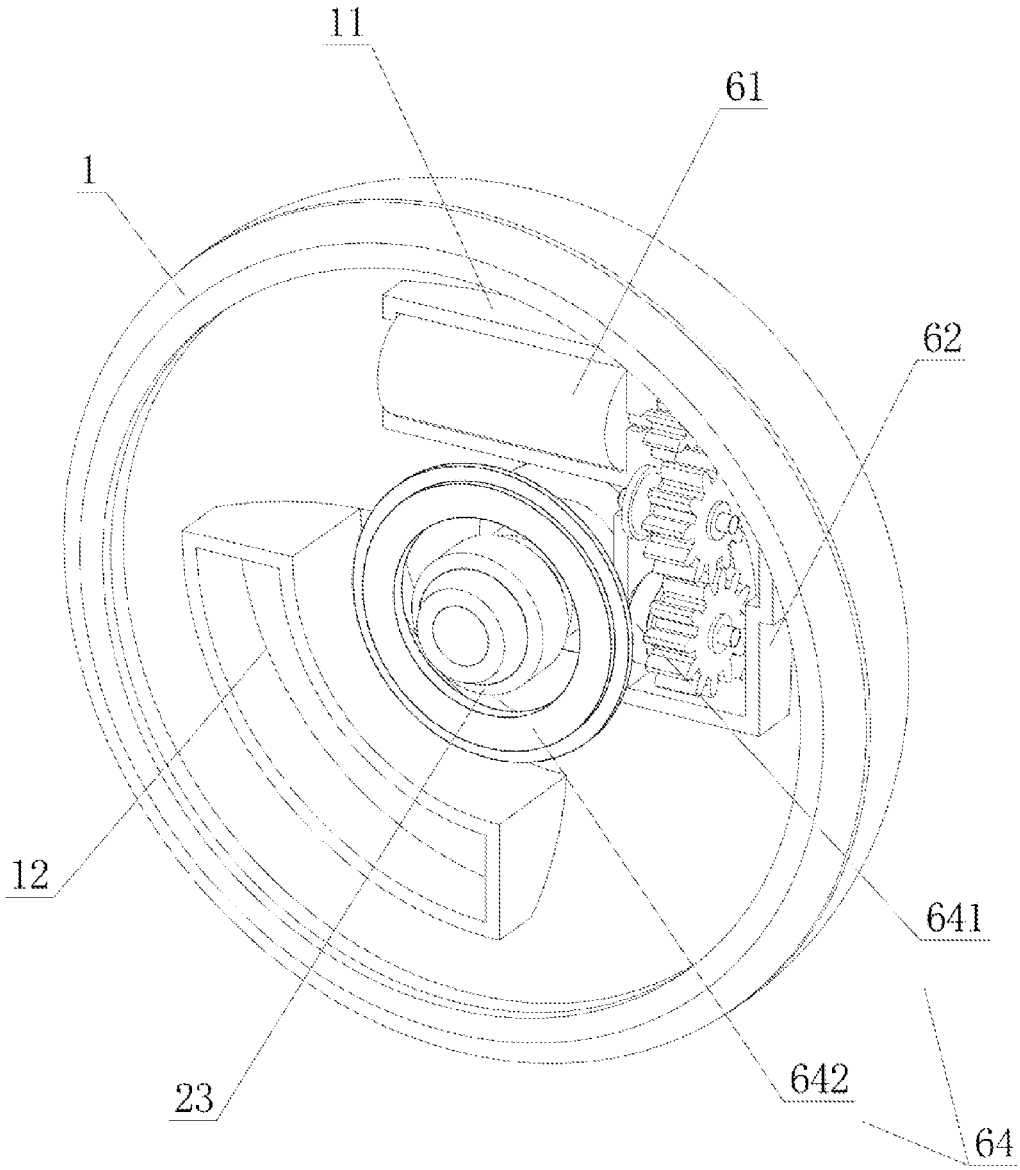
FIG. 4 is a perspective view showing the structure of the second spinning body in which the drive mechanism is provided.

As shown in FIGS. 2-3, the electrical acceleration mechanism comprises a power supply mechanism 5 and a drive mechanism 6. The power supply mechanism 5 is provided in a first spinning body of the spinning bodies 1. The drive mechanism 6 is provided in a second spinning body of the spinning bodies 1. The power supply mechanism 5 is connected with the side shaft sleeves 3 so that when the side shaft sleeves 3 are pressed, power is supplied to the drive mechanism 6 to drive the spinning bodies 1 to spin. This kind of design ensures that the two spinning bodies 1 are balanced in weight. The power supply mechanism 5 comprises a battery 51 provided inside a cavity of the first spinning body, a first spring 52 sleeving the connector 2, a gasket 53, a Printed Circuit Board (PCB) 54 and a touch switch 55 provided on the PCB 54. The battery 51 has a size and shape being the same as the cavity of the first spinning body in which it is disposed. The battery 51 is opened with a hole at its center position. The battery 51 is a specifically made battery so that its size matches with the cavity of the first spinning body and its weight is calculated to ensure that the two spinning bodies 1 on the left and right sides have equal weights. The touch switch 55 has two contact points symmetrically provided on the PCB 54 and facing to the gasket 53. The gasket 53 is an electrically conductive metal gasket. The first spring 52 is provided between the gasket 53 and the PCB 54. By pressing the side shaft sleeves 3 inwardly, the gasket 53 is pressed inwardly to touch the touch switch 55 to enable electrical connection. The drive mechanism 6 comprises a motor 61 fixed in a cavity of the second spinning body of the spinning bodies 1, a gear box 62 engaging a small gear of the motor 61, a second spring 63 sleeving the connector 2 and a motion transmission member 64 capable to transmit motion of the motor 61 to the spinning bodies 1. A mounting seat 11 is provided at one side of a bottom part of the cavity of the second spinning body. The motor 61 and the gear box 62 are mounted in the mounting seat 11. In order that the center of gravity of the second spinning body is maintained at a central axis position to prevent tilting of the second spinning body and thus affecting the spinning of the yoyo while playing the yoyo, a counterweight seat 12 is provided at a side symmetrical to where the mounting seat 11 is disposed to balance the center of gravity of the second spinning body at the central axis position. The gear box 62 is provided with two gears; a first gear of the two gears engages with the small gear of the motor 61; a second gear of the two gears is connected with the motion transmission member 64. The motion transmission member 64 comprises a first friction wheel 641 and a second friction wheel 642. The first friction wheel 641 sleeves a wheel shaft of the second gear of the gear box 62 so as to rotate together with the second gear. The second friction wheel 642 is mounted to an inner side surface of a right side shaft sleeve of the side shaft sleeves 3. The second friction wheel 642 is provided with a flange at a side facing the right side shaft sleeve. The right side shaft sleeve is provided with a groove corresponding to the flange of the second friction wheel 642. By fitting the flange and the groove, the second friction wheel 642 is fixed onto the right side shaft sleeve. As shown in FIG. 4, when the side shaft sleeves 3 are pressed inwardly, the second friction wheel 642 and the first friction wheel 641 contacts with each other so that rotation of the first friction wheel 641 is transmitted to the second friction wheel 642. As the second friction wheel 642 rotates, the second friction wheel 642 will drive the side shaft sleeves 3 to rotate. However, since the side shaft sleeves 3 are held by hands, the spinning bodies 1 are in turn being driven to rotate. Decorative covers 13 are provided at outer peripheries of cavities of the spinning bodies 1. By means of the decorative covers 13, the electrical acceleration mechanism is hidden inside the yoyo. Half of the mounting seat 11 used for mounting the motor 61 and the gear box 62 is installed on the second spinning body and half of the mounting seat 11 is installed on a respective decorative cover of the second spinning body.

As shown in FIG. 3, the connector 2 comprises two hollow link rods 21 and a hollow shaft 22. The two hollow link rods 21 are mounted on the center positions of the spinning bodies 1 respectively. One end of each of the two hollow link rods 21 is fixedly connected with a respective spinning body, while another end of each of the two hollow link rods 21 is connected with a respective side shaft sleeve by rotation via a side shaft bearing 23. Each of the two hollow link rods 21 is provided with a mounting slot 213 at a connecting portion with a respective spinning body. A hole opening portion of each of the spinning bodies 1 is provided with a protruding mounting flange 14. By fitting mounting slots and mounting flanges, hole opening portions of the spinning bodies 1 and the two hollow link rods 21 are tightly connected. The two hollow link rods 21 can be formed integrally by injection molding with their respective spinning bodies 1. The hollow shaft 22 is provided between the two hollow link rods 21 and connects the two hollow link rods 21 by threaded connection so that the spinning bodies 1 are connected to form a one whole yoyo. The two hollow link rods 21 are provided with through bores 211 at their center positions respectively and each through bore is opened through side walls of a respective hollow link rod. Electrical wires between the power supply mechanism 5 and the drive mechanism 6 can run through the through bores 211 and being arranged in the hollow link rods 21 and the hollow shaft 22 so that wiring of the electrical wires is more convenient. To ensure secured connection, ends of hollow link rods 21 extending out of their respective side shaft sleeves 3 are provided with ring-shaped grooves 212 respectively. The ring-shaped grooves 212 are fitted with rubber rings 7 respectively to prevent the hollow link rods 21 from falling off the side shaft sleeves 3.

The yoyo capable to be electrically accelerated when held by hands has the following operation principle:

Grab the side shaft sleeves 3 on the left and right sides of the yoyo by using two fingers; press the side shaft sleeves 3 lightly to compress the first spring 52 so that a respective side shaft sleeve corresponding to the first spring 52 and the side shaft bearing 23 together drive the gasket 53 to move inwardly; when the gasket 53 touches the touch switch 55 on the PCB 54 to enable electrical connection, the motor 61 starts rotating; the small gear of the motor 61 drives the gear box 62 to work and also drives the first friction wheel 641 to rotate; when both the side shaft sleeves 3 on the left and right sides are grabbed by fingers, the side shaft sleeve on the right side and the second friction wheel 642 move inwardly simultaneously; when the first friction wheel 641 and the second friction wheel 642 touch each other, the first friction wheel 641 drives the second friction wheel 642 to move due to frictional force so that the two spinning bodies 1 spin with respect to the side shaft sleeves 3; spinning speed of the yoyo starts to accelerate; when the spinning speed is high enough, release the side shaft sleeves 3; the side shaft sleeve on the left causes the gasket 53 to separate from the PCB 54 due to the resilience of the first spring 52; the touch switch 55 is then disconnected and electricity is then disconnected; the motor 61 stops but the yoyo will keep spinning due to inertia; player can then release the yoyo to perform various yoyo tricks.

The present invention described with reference to the above embodiments should not be limited by the embodiments. Any changes to the embodiments obvious to a person skilled in this field of art should fall within the scope of protection defined by the claims of the present invention.

What is claimed is:

1. A yoyo capable to be electrically accelerated when held by hands, characterized in that, it comprises two spinning bodies (1), a connector (2) connecting the two spinning bodies (1) as a whole, side shaft sleeves (3) provided at center positions of outer sides of the spinning bodies (1), an electrical acceleration mechanism provided inside the spinning bodies (1), and a bearing (4) disposed between the two spinning bodies (1) for winding a yoyo string; the electrical acceleration mechanism is connected with the spinning bodies (1); by pressing the side shaft sleeves (3), the electrical acceleration mechanism operates and thus drives the spinning bodies (1) to spin simultaneously.

2. The yoyo capable to be electrically accelerated when held by hands as claimed in claim 1, wherein the electrical acceleration mechanism comprises a power supply mechanism (5) and a drive mechanism (6); the power supply mechanism (5) is provided in a first spinning body of the spinning bodies (1); the drive mechanism (6) is provided in a second spinning body of the spinning bodies (1); the power supply mechanism (5) is connected with the side shaft sleeves (3) so that when the side shaft sleeves (3) are pressed, power is supplied to the drive mechanism (6) to drive the spinning bodies (1) to spin simultaneously.

3. The yoyo capable to be electrically accelerated when held by hands as claimed in claim 2, wherein the power supply mechanism (5) comprises a battery (51) provided inside a cavity of the first spinning body, a first spring (52) sleeving the connector (2), a gasket (53), a Printed Circuit Board (PCB) (54) and a touch switch (55) provided on the PCB (54); the first spring (52) is provided between the gasket (53) and the PCB (54); by pressing the side shaft sleeves (3) inwardly, the gasket (53) is pressed inwardly to touch the touch switch (55) to enable electrical connection.

4. The yoyo capable to be electrically accelerated when held by hands as claimed in claim 2, wherein the drive mechanism (6) comprises a motor (61) fixed in a cavity of the second spinning body of the spinning bodies (1), a gear box (62) engaging a small gear of the motor (61), a second spring (63) sleeving the connector (2) and a motion transmission member (64) capable to transmit motion of the motor (61) to the spinning bodies (1); when the side shaft sleeves (3) are pressed inwardly, the motion transmission member (64) engages with a first gear of the gear box (62) so that rotation of gears is transformed to spinning of the spinning bodies (1).

5. The yoyo capable to be electrically accelerated when held by hands as claimed in claim 3 or 4, wherein the connector (2) comprises two hollow link rods (21) and a hollow shaft (22); the two hollow link rods (21) are mounted on center positions of the spinning bodies (1) respectively; one end of each of the two hollow link rods (21) is fixedly connected with a respective spinning body of the spinning bodies (1), while another end of each of the two hollow link rods (21) is connected with a respective side shaft sleeve of the side shaft sleeves (3) by rotation via a side shaft bearing (23); the hollow shaft (22) is provided between the two hollow link rods (21) and connects the two hollow link rods (21) by threaded connection so that the spinning bodies (1) are connected together as a whole.

6. The yoyo capable to be electrically accelerated when held by hands as claimed in claim 5, wherein the two hollow link rods (21) are provided with through bores (211) at their center positions respectively and each through bore is opened through side walls of a respective hollow link rod; electrical wires between the power supply mechanism (5) and the drive mechanism (6) run through the through bores (211) and being arranged in the hollow link rods (21) and the hollow shaft (22).

7. The yoyo capable to be electrically accelerated when held by hands as claimed in claim 5, wherein ends of the hollow link rods (21) extending out of their respective side shaft sleeves (3) are provided with ring-shaped grooves (212) respectively; the ring-shaped grooves (212) are fitted with rubber rings (7) respectively to prevent the hollow link rods (21) from falling off the side shaft sleeves (3).

8. The yoyo capable to be electrically accelerated when held by hands as claimed in claim 4, wherein the motion transmission member (64) comprises a first friction wheel (641) and a second friction wheel (642); the first friction wheel (641) sleeves a wheel shaft of a second gear of the gear box (62) so as to rotate together with the second gear; the second friction wheel (642) is mounted to an inner side surface of a right side shaft sleeve of the side shaft sleeves (3); by pressing the side shaft sleeves (3) inwardly so that the first friction wheel (641) and the second friction wheel (642) contact with each other, rotational movement of the first friction wheel (641) is transferred to the second friction wheel (642) to rotate the second friction wheel (642) which in turn drives the spinning bodies (1) to spin.

9. The yoyo capable to be electrically accelerated when held by hands as claimed in claim 4, wherein a mounting seat (11) is provided at one side of a bottom part of the cavity of the second spinning body; a counterweight seat (12) is provided at a side symmetrical to where the mounting seat (11) is disposed to balance the center of gravity of the second spinning body; the motor (61) and the gear box (62) are mounted in the mounting seat (11).

10. The yoyo capable to be electrically accelerated when held by hands as claimed in claim 3, wherein the battery (51) has a size and shape being the same as the cavity of the first spinning body in which it is disposed; the battery (51) is opened with a hole at its center position.

* * * * *